US011526185B2

(12) United States Patent
Bhattad et al.

(10) Patent No.: US 11,526,185 B2
(45) Date of Patent: Dec. 13, 2022

(54) LINEAR REGULATOR WITH TEMPERATURE COMPENSATED BIAS CURRENT

(71) Applicant: Dialog Semiconductor (UK) Limited, London (GB)

(72) Inventors: Ambreesh Bhattad, Swindon (GB); Frank Kronmueller, Kirchheim/Teck (DE)

(73) Assignee: Dialog Semiconductor (UK) Limited, London (GB)

( * ) Notice: Subject to any disclaimer, the term of this patent is extended or adjusted under 35 U.S.C. 154(b) by 100 days.

(21) Appl. No.: 17/066,231

(22) Filed: Oct. 8, 2020

(65) Prior Publication Data

US 2021/0109553 A1 Apr. 15, 2021

(30) Foreign Application Priority Data

Oct. 9, 2019 (DE) ..... 102019215494.8

(51) Int. Cl.
*G05F 1/46* (2006.01)
*G05F 1/575* (2006.01)
*G05F 1/567* (2006.01)

(52) U.S. Cl.
CPC ..... *G05F 1/461* (2013.01); *G05F 1/467* (2013.01); *G05F 1/567* (2013.01); *G05F 1/575* (2013.01)

(58) Field of Classification Search
CPC . G05F 1/56; G05F 1/565; G05F 1/575; G05F 1/59; G05F 1/595;
(Continued)

(56) References Cited

U.S. PATENT DOCUMENTS 5,548,205 A * 8/1996 Monticelli ..... G05F 1/565 323/280
6,744,303 B1 * 6/2004 Maley ..... G05F 1/46 327/543
(Continued)

FOREIGN PATENT DOCUMENTS

CN 108958345 A * 12/2018 ..... G05F 1/461
DE 4431466 C1 6/1995
DE 102019204594 B3 * 6/2020 ..... G05F 1/575

OTHER PUBLICATIONS

German Office Action, File No. 10 2019 215 494.8. Applicant: Dialog Semiconductor (UK) Limited, dated Jul. 7, 2021, 10 pages.

*Primary Examiner* — Kevin J Comber
*Assistant Examiner* — Nusrat Quddus
(74) *Attorney, Agent, or Firm* — Saile Ackerman LLC; Stephen B. Ackerman

(57) ABSTRACT

A solid-state circuit is presented which may comprise a pass device, a control circuit, and a leakage current compensation circuit. The pass device may have a first terminal, a second terminal and a drive terminal, wherein the first terminal of the pass device is coupled with an input terminal of the solid-state circuit, and wherein the second terminal of the pass device is coupled with an output terminal of the solid-state circuit. The control circuit may be coupled with the drive terminal of the pass device and may be configured to drive the pass device with a driving voltage. The leakage current compensation circuit may be configured to receive a leakage current of the pass device and may be configured to forward said leakage current as a bias current to said control circuit.

15 Claims, 8 Drawing Sheets

(58) Field of Classification Search
CPC .... G05F 1/461–468; H03F 1/30; H03F 1/301; H03F 1/305; H03F 1/343; H03F 1/345; H03F 2203/45674
See application file for complete search history.

(56) References Cited

U.S. PATENT DOCUMENTS

| | | | | |
|---|---|---|---|---|
| 6,856,190 | B2 * | 2/2005 | Kihara | H03F 1/30 327/544 |
| 8,829,883 | B2 * | 9/2014 | Samid | G05F 1/56 323/315 |
| 9,063,954 | B2 * | 6/2015 | Ioffe | G06F 16/583 |
| 11,099,590 | B2 * | 8/2021 | Azevedo | H03F 3/45183 |
| 2006/0113972 | A1 * | 6/2006 | Mihara | G05F 1/575 323/273 |
| 2008/0157875 | A1 * | 7/2008 | Behzad | H03F 3/45183 330/288 |
| 2013/0265020 | A1 * | 10/2013 | Krenzke | G05F 1/56 323/273 |
| 2016/0018834 | A1 * | 1/2016 | Kronmueller | G05F 1/468 323/280 |
| 2016/0239038 | A1 * | 8/2016 | Wang | G05F 3/267 |
| 2019/0258282 | A1 * | 8/2019 | Magod Ramakrishna | G05F 1/575 |
| 2020/0310478 | A1 * | 10/2020 | Azevedo | H03F 3/45183 |
| 2022/0229455 | A1 * | 7/2022 | Zhong | G05F 3/262 |

* cited by examiner

LINEAR REGULATOR WITH TEMPERATURE COMPENSATED BIAS CURRENT

TECHNICAL FIELD

The present document relates to solid-state circuits with leakage current compensation. In particular, the present document relates to linear regulators such as e.g. low-dropout (LDO) regulators with leakage current compensation circuits.

BACKGROUND

Linear regulators or low-dropout (LDO) regulators are widely used in a variety of systems to provide a regulated voltage to other circuit components. In general, such regulators are required to provide and maintain a constant voltage across a wide variety of loads and/or operating frequencies in electrical applications. In particular, it is desirable to provide a stable and accurately regulated output voltage from an unregulated and many times noisy input voltage, i.e. typically the supply voltage of the regulator.

Linear regulators typically operate between at least two supply rails, such as the supply voltage VDD (e.g. a battery voltage) and a reference voltage GND (e.g. ground). As a result of this, the voltage regulator behaves as a circuit consuming quiescent current. This quiescent current is in addition to the load current which is provided to a load of the voltage regulator. Hence, the use of a voltage regulator for providing a regulated voltage (e.g. based on the voltage of a battery) leads to an increased power consumption.

The control and compensation circuits of a linear regulator may be regarded as devices which process time-varying signals, and which require a steady current and/or voltage to operate correctly. The latter current is denoted as bias current in the present document. Put in a different way, the bias current is required to establish a proper operating condition for said control and compensation circuits of a linear regulator.

Concerning leakage current, it should be noted that—although other circuit components of the linear regulator may also contribute to the overall leakage current of the regulator—the pass device is regarded as the main source of leakage current within the present document.

SUMMARY

The present document addresses two major components of said quiescent current: The first component is the leakage current flowing through a pass device of a linear regulator. The second component is the bias current required for stable operation of the control and compensation circuits configured to generate a drive signal for driving said pass device.

The present document addresses the above-mentioned technical problems. In particular, the present document addresses the technical problem of providing a solid-state device with improved dynamic response, increased noise immunity over a greater bandwidth, a reduced noise on the output of the solid-state circuit, and/or a reduced power consumption.

According to an aspect, a solid-state circuit is presented which may comprise a pass device, a control circuit, and a leakage current compensation circuit. The pass device may have a first terminal, a second terminal and a drive terminal, wherein the first terminal of the pass device is coupled with an input terminal of the solid-state circuit, and wherein the second terminal of the pass device is coupled with an output terminal of the solid-state circuit. The control circuit may be coupled with the drive terminal of the pass device and may be configured to drive the pass device with a driving voltage. The leakage current compensation circuit may be configured to receive a leakage current of the pass device and may be configured to forward said leakage current as a bias current to said control circuit.

By re-using the leakage current as a bias current of the control circuit, it becomes possible to increase the bias current without increasing the overall current injected into said solid-state circuit. For instance, this may be achieved by integrating the leakage current compensation circuit with a circuit configured to provide the bias current to said control circuit. The result is an improved dynamic response, increased noise immunity over a greater bandwidth, and reduced noise at the output terminal of the solid-state circuit.

For example, the solid-state circuit may be a linear regulator. More specifically, the solid-state circuit may be a low-dropout (LDO) regulator. The bias current may be regarded as current required by the control circuit to provide the correct driving signals to the pass device. The pass device itself may be a transistor such as e.g. a metal-oxide-semiconductor field effect transistor (MOSFET). The first terminal of the pass device may be a source terminal of the MOSFET, the second terminal of the pass device may be a drain terminal of the MOSFET, and the drive terminal of the pass device may be a gate terminal of the MOSFET.

The leakage current compensation circuit may be coupled to the second terminal of the pass device to receive the leakage current of the pass device. For example, the leakage current compensation circuit may be coupled to the output terminal of the solid-state circuit to receive the leakage current.

The driver circuit may comprise various control circuits, compensation circuits, as well as driver circuits for generating a driving signal of the pass device. For instance, the control circuit may comprise a differential amplifier stage configured to generate an intermediate signal based on a difference between a reference signal and a feedback signal indicative of an output voltage at the output terminal of the solid-state device. In other words, the solid-state circuit may comprise a feedback loop comprising said differential amplifier stage and said pass device. At this, said feedback signal may be e.g. derived from the output voltage using a resistive divider comprising two or more resistors. The leakage current compensation circuit may be configured to forward the leakage current to said differential amplifier stage such that the leakage current serves as bias current of the differential amplifier stage.

The control circuit may comprise a further amplifier stage coupled between the differential amplifier stage and the pass device, and the leakage current compensation circuit may be configured to forward the leakage current to said differential amplifier stage and said further amplifier stage such that the leakage current serves as bias currents of the differential amplifier stage and the further amplifier stage. The leakage current may increase as a function of temperature.

Furthermore, the control circuit may be characterized by a minimum bias current, and the solid-state circuit may be configured to provide only the leakage current to the control circuit when the leakage current is greater than the minimum bias current. At this, the minimum bias current may be the minimum bias current required by the control circuit to function correctly. Thus, in the described scenario, the solid-state circuit may not be configured to provide any additional current to the control circuit for maintaining operation of said control circuit. Thus, by re-using the leakage current, the performance of the solid-state circuit in terms of power consumption improves significantly. Since the leakage current of a solid-state circuit may increase with increasing temperature, the leakage current provided by the leakage current compensation circuit may be substantially larger than the minimum bias current when the temperature of the solid-state circuit increases. This results in an improved dynamic response, increased noise immunity over a greater bandwidth, and a reduced noise on the output of the solid-state circuit.

On the other hand, the solid-state circuit may be configured to provide the minimum leakage current to the control circuit when the leakage current is smaller than the minimum bias current. For example, the solid-state circuit may be configured to provide an additional current to the control circuit, wherein said additional current compensates for a difference between the minimum bias current and the leakage current. Thus, also in this scenario, the performance of the solid-state circuit with regard to power consumption, dynamic response, and noise immunity is substantially improved.

The solid-state circuit may comprise a comparator configured to compare the leakage current with the minimum bias current required by the control circuit. Optionally, the solid-state circuit may be configured to measure a value of the leakage current. The solid-state circuit may comprise a switching network configured to provide, based on an output signal of said comparator, the leakage current of the leakage current compensation unit and/or an additional supply current to the control circuit.

According to another aspect, a method for operating a solid-state circuit is described. The method may comprise steps which correspond to the features of the solid-state circuit described in the present document. Specifically, the method is designed for a solid-state circuit comprising a pass device having a first terminal, a second terminal and a drive terminal, wherein the first terminal of the pass device is coupled with an input terminal of the solid-state circuit, and wherein the second terminal of the pass device is coupled with an output terminal of the solid-state circuit. The solid-state circuit may comprise a control circuit coupled with the drive terminal of the pass device. The method may comprise driving, by the control circuit, the pass device with a driving voltage. The method may comprise receiving, by a leakage current compensation circuit, a leakage current of the pass device. Moreover, the method may comprise forwarding, by the leakage current compensation circuit, said leakage current as a bias current to said control circuit.

The leakage current compensation circuit may be coupled to the second terminal of the pass device to receive the leakage current of the pass device. Further, the control circuit may comprise a differential amplifier stage for generating an intermediate signal based on a difference between a reference signal and a feedback signal indicative of an output voltage at the output terminal of the solid-state device. The method may comprise forwarding, by the leakage current compensation circuit, the leakage current to said differential amplifier stage.

The control circuit may comprise a further amplifier stage coupled between the differential amplifier stage and the pass device. The method may comprise forwarding, by the leakage current compensation circuit, the leakage current to said differential amplifier stage and said further amplifier stage. The leakage current may increase as a function of temperature.

The control circuit may be characterized by a minimum bias current, and the method may comprise providing only the leakage current to the control circuit when the leakage current is greater than the minimum bias current. Alternatively, or additionally, the method may further comprise providing the minimum leakage current to the control circuit when the leakage current is smaller than the minimum bias current.

According to a further aspect, a software program is described. The software program may be adapted for execution on a processor and for performing the method steps outlined in the present document when carried out by the processor.

According to another aspect, a storage medium is described. The storage medium may comprise a software program adapted for execution on a processor and for performing the method steps outlined in the present document when carried out by the processor.

According to a further aspect, a computer program product is described. The computer program product may comprise instructions for performing the method steps outlined in the present document when carried out by the processor.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple", "connect", "coupled" or "connected" refers to elements being in electrical communication with each other, whether directly connected e.g., via wires, or in some other manner.

BRIEF DESCRIPTION OF THE DRAWINGS

The present invention is illustrated by way of example, and not by way of limitation, in the figures of the accompanying drawings in which like reference numerals refer to similar or identical elements, and in which.

DETAILED DESCRIPTION

Figure 1:
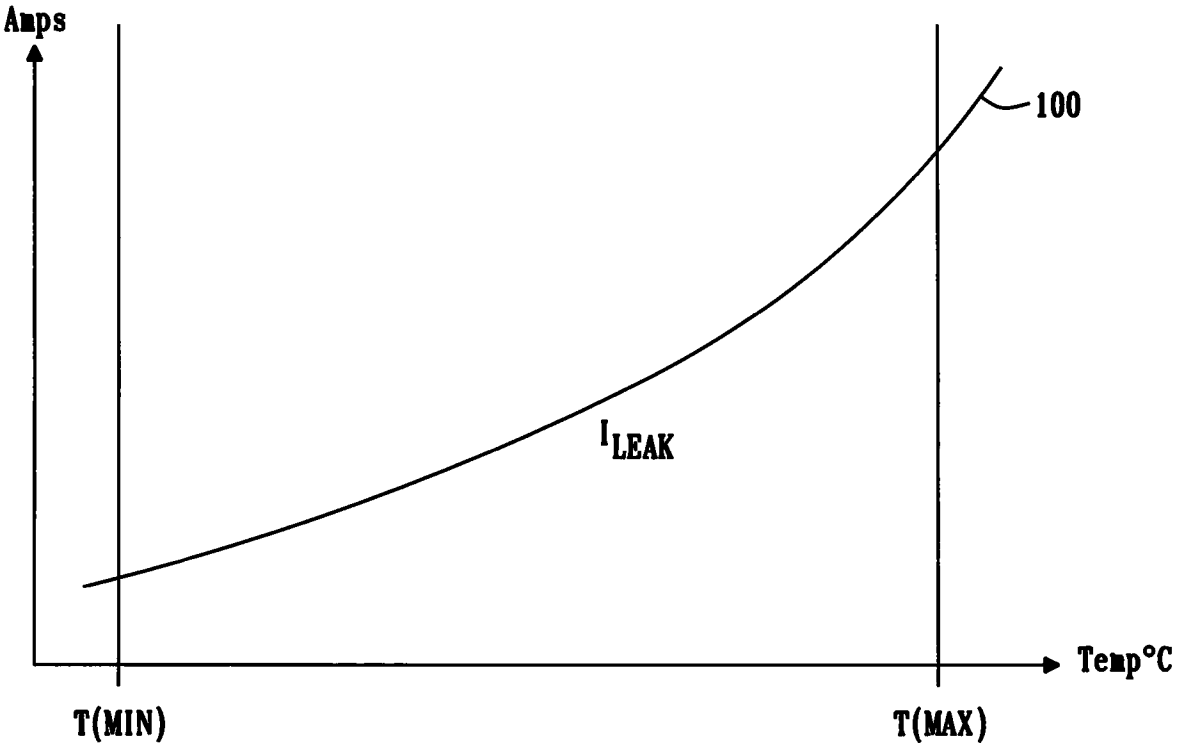
FIG. 1 Prior Art
FIG. 1 shows a diagram showing leakage current versus temperature.

FIG. 1 shows a diagram 1 showing leakage current versus temperature, of the prior art. All solid-state circuits exhibit leakage current. As shown by FIG. 1, the leakage current $I_{LEAK}$ 100 varies non-linearly with temperature T. To be more specific, the leakage current is illustrated in diagram 1 as a continuous, increasing and convex function of the temperature of the solid-state circuit.

Figure 2:
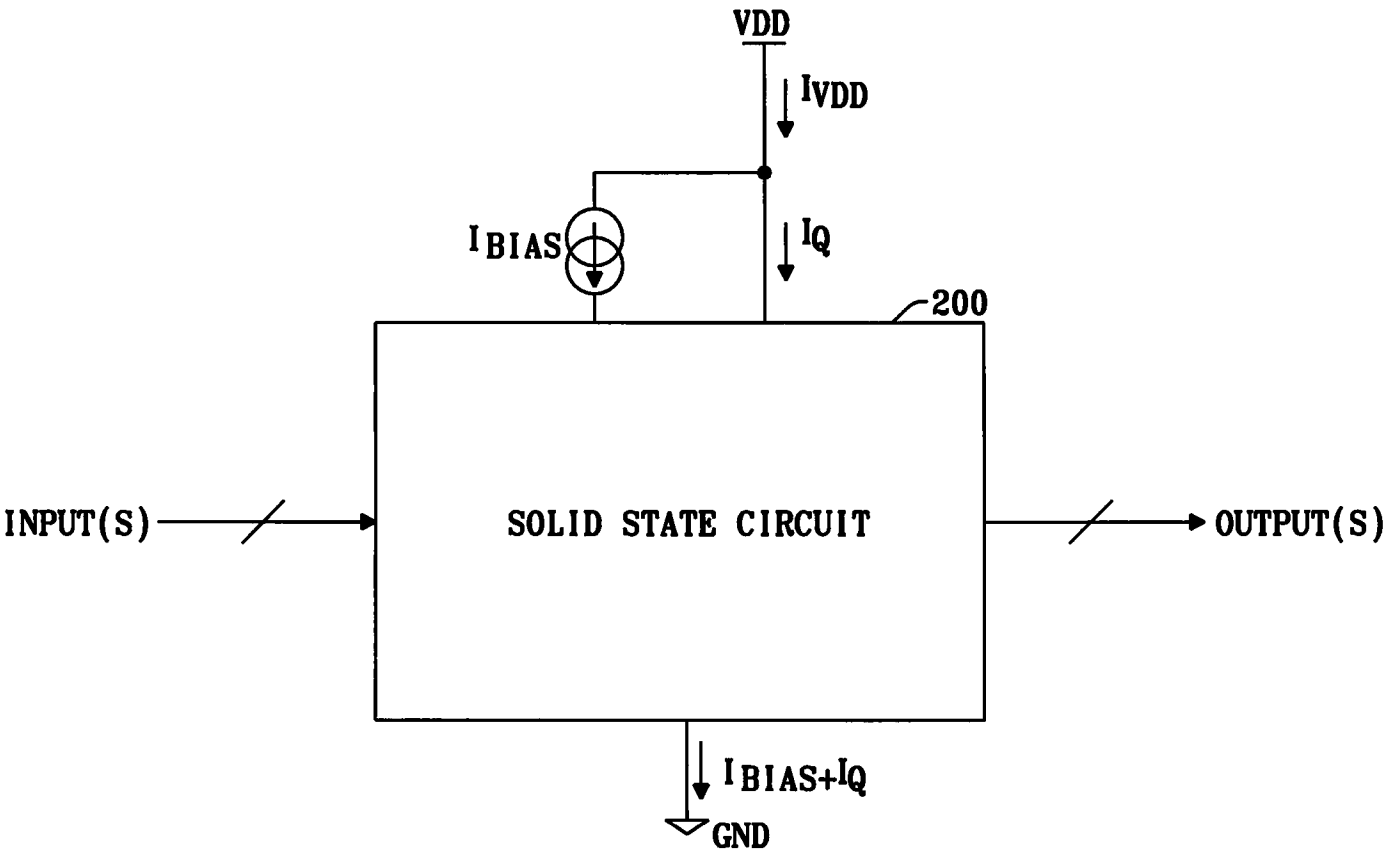
FIG. 2 Prior Art
FIG. 2 shows currents and voltages in a solid-state circuit.

FIG. 2 shows currents and voltages in a solid-state circuit, of the prior art. More specifically, FIG. 2 depicts a schematic circuit diagram of a solid-state circuit 200 which is connected between a supply voltage $V_{DD}$ and ground GND. As illustrated in FIG. 2, to properly operate the solid-state circuit 200, a bias current $I_{BIAS}$ and a current $I_Q$ must be provided. $I_{BIAS}$ may generally refer to the current needed to operate the circuit. The current $I_Q$ is based on a leakage current $I_{LEAK}$ at the worst-case operating temperature. The current from the supply ($I_{VDD}$) may be seen as the sum of $I_{BIAS}$ and $I_Q$. In order for the solid-state circuit to operate correctly, there should be compensation for the leakage current $I_{LEAK}$. The corresponding power may be described with the following formula:

$$P_{LOSS}=V_{DD}\times(I_Q I_{LEAK}).$$

Figure 3:
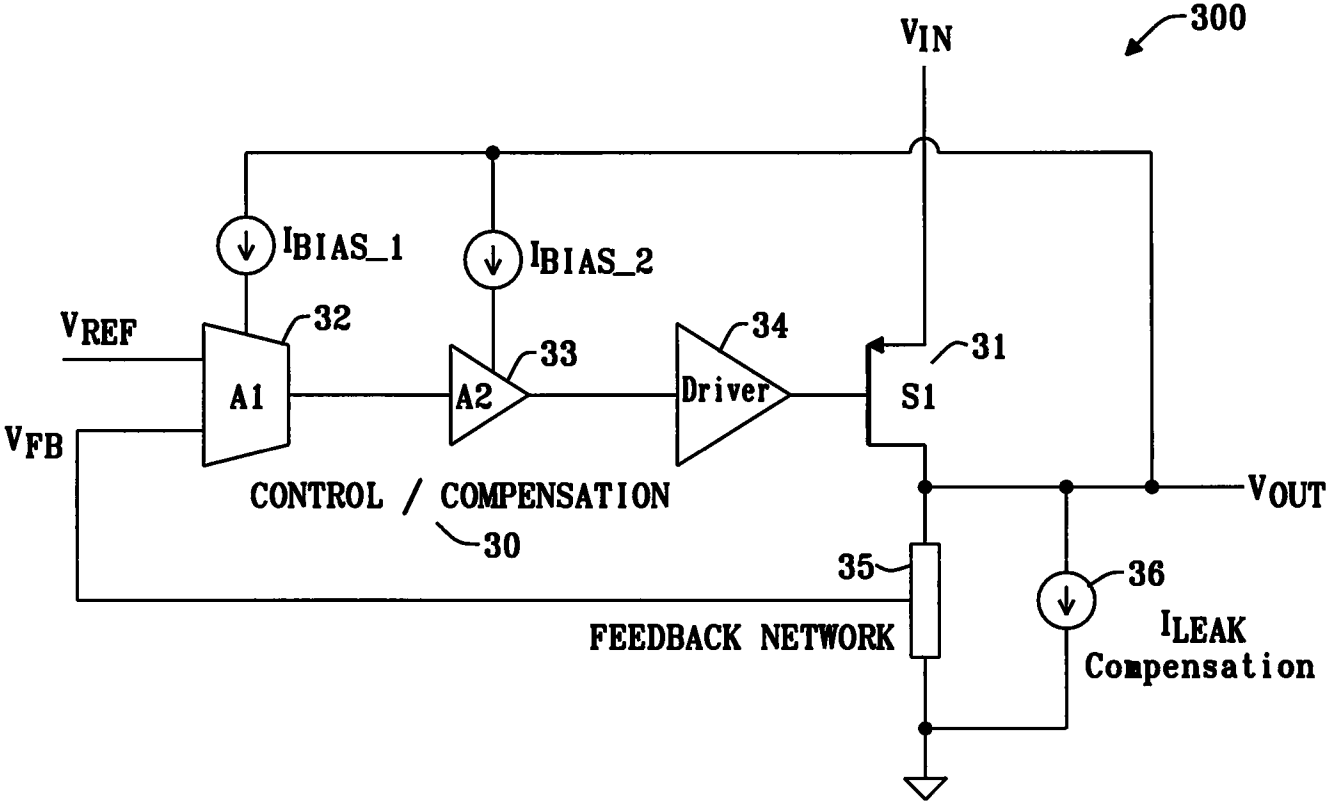
FIG. 3 Prior Art
FIG. 3 shows a circuit diagram of a linear regulator.

A specific example of a solid-state circuit is a linear regulator. FIG. 3 shows a circuit diagram of a linear regulator 300 which is embodied as a low-dropout (LDO) regulator, of the prior art. The exemplary linear regulator 300 comprises a pass device 31, a control circuit 30, and a leakage current compensation unit 36. The pass device 31 may have a first terminal, a second terminal and a drive terminal, wherein the first terminal of the pass device 31 is coupled with an input terminal of the linear regulator 300, and wherein the second terminal of the pass device 31 is coupled with an output terminal of the linear regulator 300. The control circuit 30 may be coupled with the drive terminal of the pass device 31 and may be configured to drive the pass device 31 with a driving voltage. In the illustrated example, the leakage current compensation unit 36 is coupled between the output terminal of the linear regulator 300 and ground.

In the example of FIG. 3, the control circuit 30 comprises a differential amplifier stage 32, a further amplifier stage 33, and an optional driver stage 34. The differential amplifier stage 32 may be configured to generate an intermediate signal based on a difference between a reference signal $V_{REF}$ and a feedback signal indicative of an output voltage $V_{OUT}$ at the output terminal of the linear regulator 300. The linear regulator 300 may further comprise a feedback network 35 for generating said feedback signal based on the output voltage $V_{OUT}$. As can be seen, the differential amplifier stage 32 and the further amplifier stage 33 are driven by respective bias currents IBIAS_1 and IBIAS_2 which are derived from the output terminal of the linear regulator 300. Also, the driver 34 may be driven by a respective bias current which is derived from the output terminal of the linear regulator 300 (not shown in FIG. 3).

The linear regulator 300 may employ direct feedback, as the bias currents for the control and compensation circuits 32, 33 are provided directly from the output of the LDO. This has many advantages, including superior noise immunity. Further, the main pass element(s), shown as a single device S1 31 in FIG. 3, is the major source of the LDO's leakage current $I_{LEAK}$. Since there should be compensation for $I_{LEAK}$, the linear regulator 300 has the $I_{LEAK}$ compensation circuit 36, which essentially sources/sinks the leakage current $I_{LEAK}$ to ground.

Figure 4:
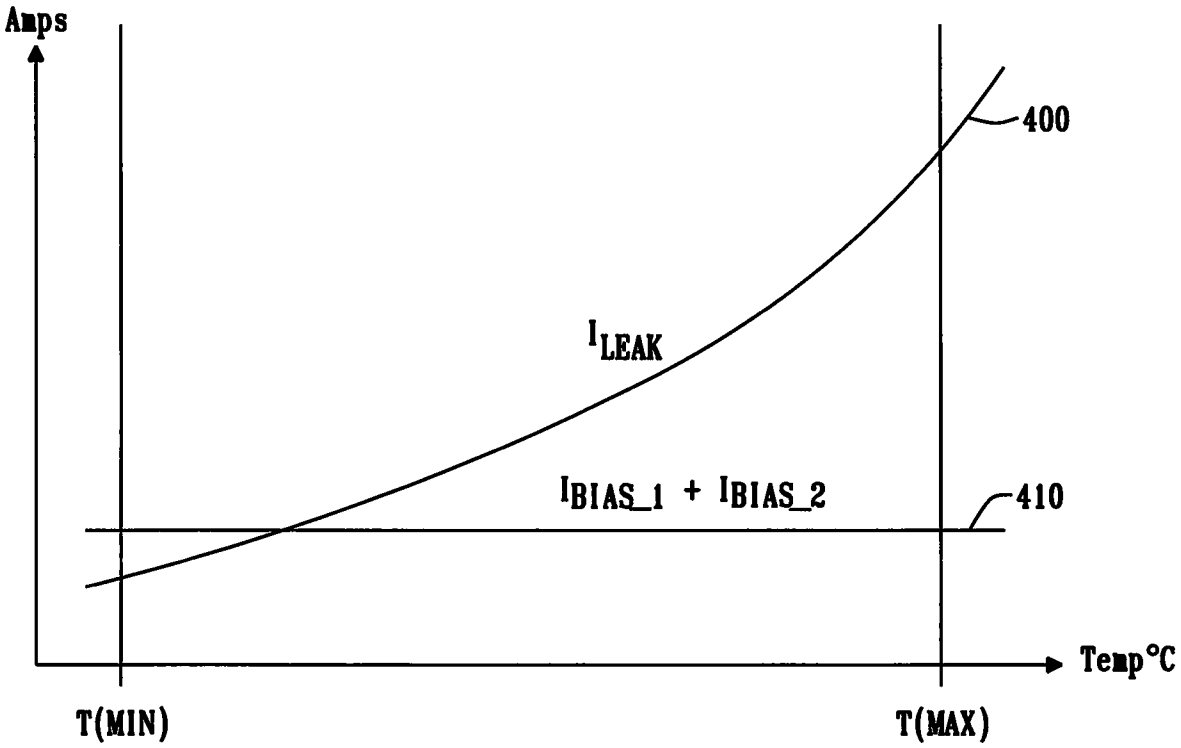
FIG. 4 Prior Art
FIG. 4 shows another diagram showing leakage currents and bias currents versus temperature.

FIG. 4 shows another diagram showing leakage currents and bias currents versus temperature, of the prior art. In particular, FIG. 4 shows the leakage current $I_{LEAK}$ 400 and curves for the LDO shown in FIG. 3 as a function of temperature. Again, current $I_Q$ may be seen as the sum of the leakage current $I_{LEAK}$ and the bias currents $I_{BIAS1}$ and $I_{BIAS2}$ 410.

Figure 5:
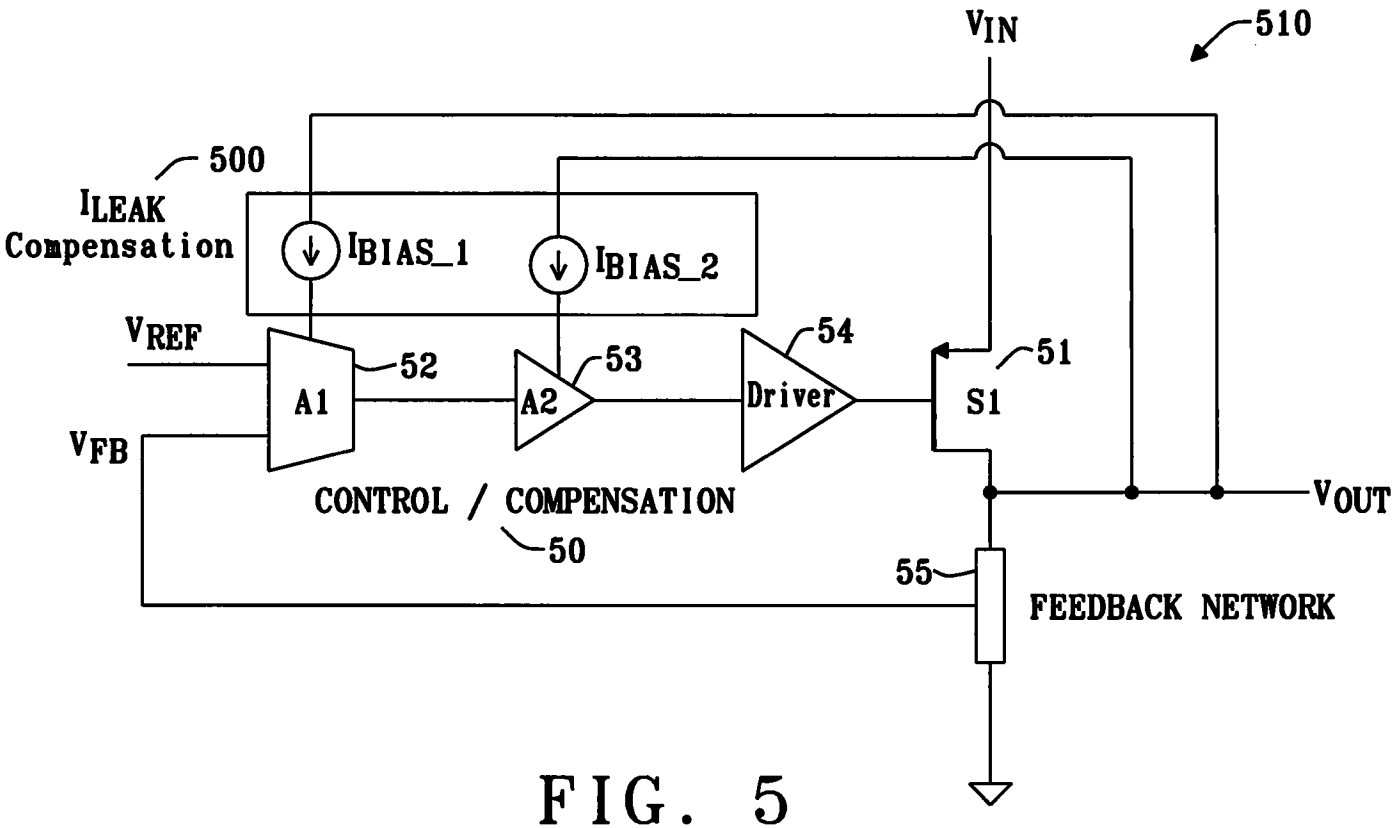
FIG. 5 shows another circuit diagram of a linear regulator, of the present disclosure.

FIG. 5 shows another circuit diagram of a linear regulator 510, wherein a leakage current compensation circuit 500 sources the bias currents $I_{BIAS1}$ and $I_{BIAS2}$, in the present disclosure. In the example of FIG. 5, the control circuit 50 comprises a differential amplifier stage 52, a further amplifier stage 53, and an optional driver stage 54 for driving pass device 51. The differential amplifier stage 52 may be configured to generate an intermediate signal based on a difference between a reference signal $V_{REF}$ and a feedback signal indicative of an output voltage $V_{OUT}$ at the output terminal of the linear regulator 510. The linear regulator 510 may further comprise a feedback network 55 for generating said feedback signal based on the output voltage $V_{OUT}$.

As can be seen, the differential amplifier stage 52 and the further amplifier stage 53 are driven by respective bias currents IBIAS_1 and IBIAS_2 which are generated by the leakage current compensation circuit 500 which is configured to receive a leakage current of the pass device 51 and to forward said leakage current as a bias current to the differential amplifier stage 52 and the further amplifier stage 53 of control circuit 50. Also, the driver 54 may be driven by a respective bias current which generated by leakage current compensation circuit 500 (not shown in FIG. 5).

As mentioned above, the present invention increases the bias current without increasing $I_Q$. This may be achieved by integrating the $I_{LEAK}$ compensation circuit with the $I_{BIAS}$ source. The leakage current, instead of being sourced directly to GND, is further used as a bias current source. There is an added benefit in that the leakage current may increase as a function of temperature. At the same time, the transconductance may decrease as a function of temperature. By using the leakage current as a bias current source, the bias current can be increased as the temperature increases, which is very beneficial. The result is greater LDO performance, including improving dynamic response, increase noise immunity over a greater bandwidth, and reducing noise on the output.

Figure 6A:
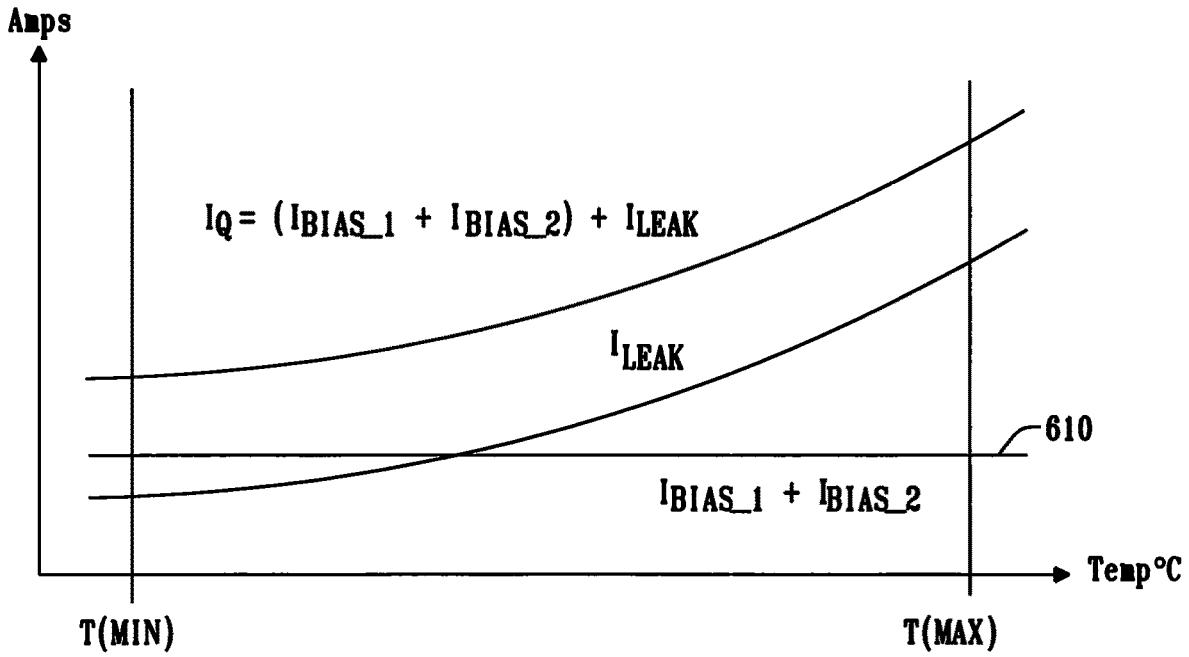
FIG. 6A Prior Art
FIG. 6A and 6B show two diagrams showing currents versus temperature.
Figure 6B:
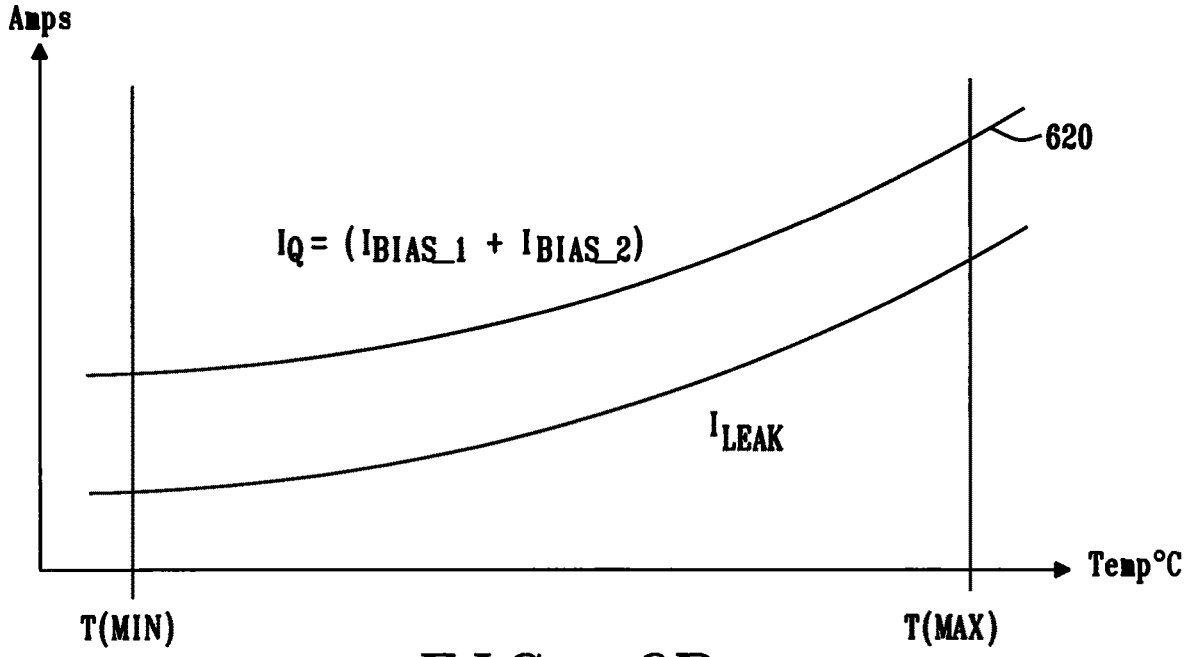

FIG. 6A and B show two diagrams showing currents versus temperature. Specifically, FIG. 6A and 6B depict a comparison between the prior art circuit of FIG. 2 and the circuit in FIG. 5 in terms of $I_Q$, $I_{LEAK}$, and $I_{BIAS}$. By comparing the $I_{BIAS}$ 610 in FIG. 6A (relating to the circuit in FIG. 2) with the $I_{BIAS}$ 620 in FIG. 6B (relating to the circuit in FIG. 5), one can see that it is significantly greater in in FIG. 6B without increasing $I_Q$. Hence, this would result in the highest performance while maintaining an equivalent $I_Q$.

Figure 7A:
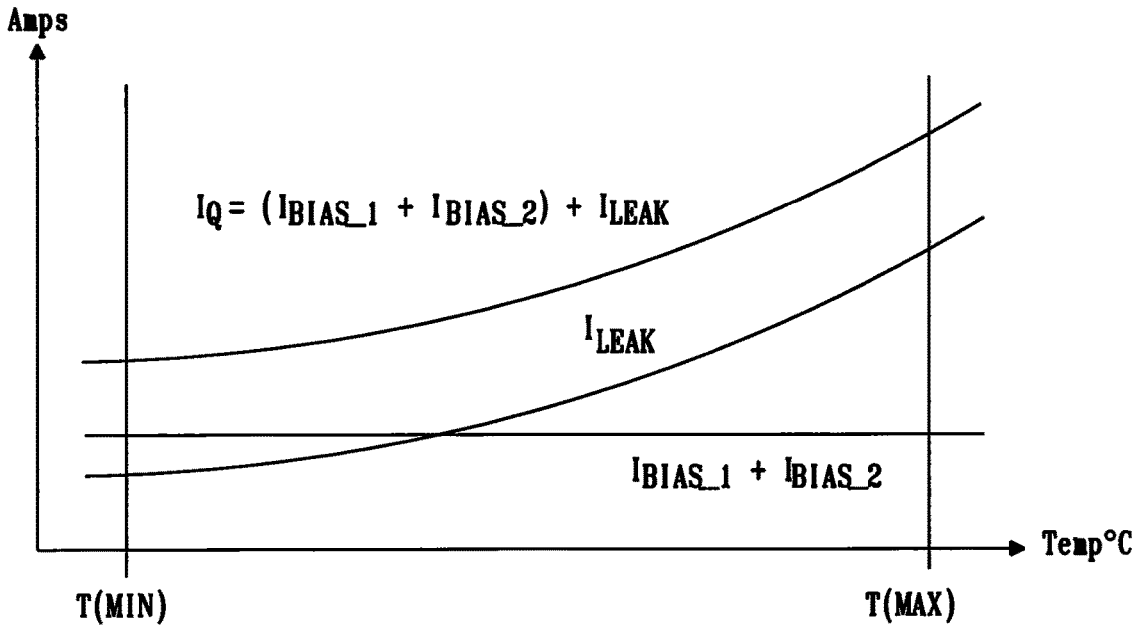
FIG. 7A Prior Art
FIG. 7A and 7B show two further diagrams showing currents versus temperature.
Figure 7B:
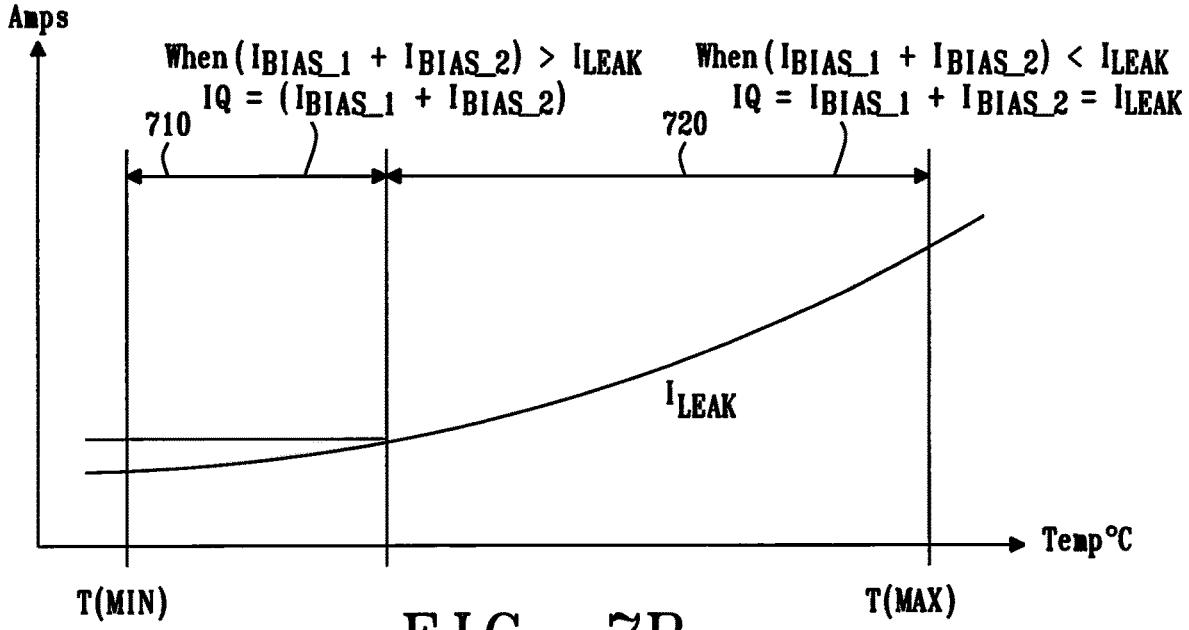

FIG. 7A and 7B show two further diagrams showing currents versus temperature. Again, FIG. 7A relates to the prior art circuit in FIG. 2, and FIG. 7B relates to the circuit in FIG. 5. The diagrams in FIG. 7A and 7B illustrate how performance can be improved by increasing $I_{BIAS}$ and reducing $I_Q$. As one can see, there are two sections, one section where the bias current is lower than the leakage current 720, and one section where the bias current is greater than the leakage current 710. During the period when the bias current is greater than the leakage current 710, the following relations hold:

When $(IBIAS_1+IBIAS_2)>ILEAK\ IQ=(IBIAS_1+IBIAS_2)$.

During the period when the bias current is less than the leakage current 720, the following relations hold:

When $(IBIAS_1+IBIAS_2)<ILEAK\ IQ=IBIAS_1+IBIAS_2=ILEAK$

This results in minimizing $I_Q$ while still increasing $I_{BIAS}$.

Figure 8:
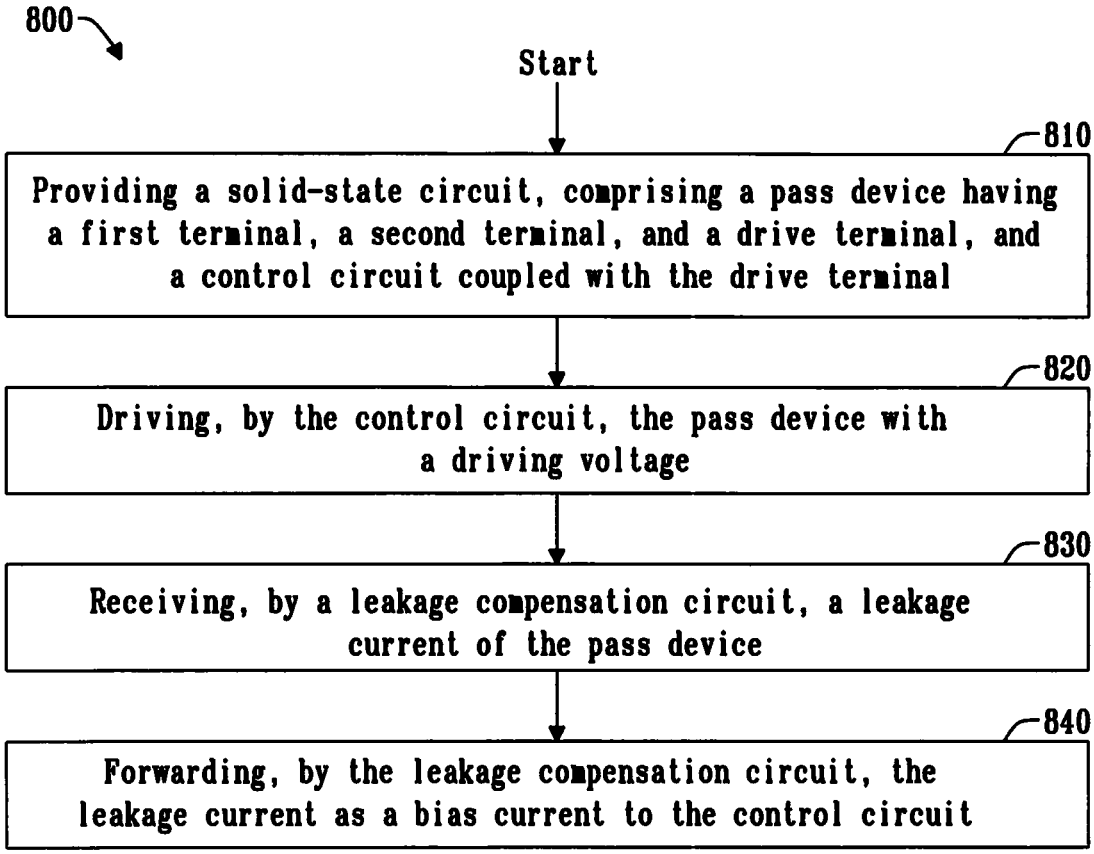
FIG. 8 shows a flowchart for a method of operating a solid-state circuit.

FIG. 8 shows 800, a method for operating a solid-state circuit. The steps include 810, providing a solid-state circuit comprising a pass device having a first terminal, a second terminal and a drive terminal, and a control circuit coupled with the drive terminal. The steps also include 820, driving, by the control circuit, the pass device with a driving voltage. The steps also include 830, receiving, by a leakage current compensation circuit, a leakage current of the pass device. The steps also include 840, forwarding, by the leakage current compensation circuit, the leakage current as a bias current to the control circuit.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A solid-state circuit comprising:

a pass device having a first terminal, a second terminal and a drive terminal, wherein the first terminal of the pass device is coupled with an input terminal of the solid-state circuit, and wherein the second terminal of the pass device is coupled with an output terminal of the solid-state circuit;

a control circuit coupled with the drive terminal of the pass device and configured to drive the pass device with a driving voltage; and a leakage current compensation circuit configured to receive a leakage current of the pass device and to forward said leakage current as a bias current to said control circuit.

2. The solid-state circuit of claim 1, wherein the leakage current compensation circuit is coupled to the second terminal of the pass device to receive the leakage current of the pass device.

3. The solid-state circuit of claim 1, wherein the control circuit comprises a differential amplifier stage configured to generate an intermediate signal based on a difference between a reference signal and a feedback signal indicative of an output voltage at the output terminal of the solid-state device.

4. The solid-state circuit of claim 3, wherein the leakage current compensation circuit is configured to forward the leakage current to said differential amplifier stage.

5. The solid-state circuit of claim 3, wherein the control circuit comprises a further amplifier stage coupled between the differential amplifier stage and the pass device, and wherein the leakage current compensation circuit is configured to forward the leakage current to said differential amplifier stage and said further amplifier stage.

6. The solid-state circuit of claim 1, wherein the leakage current increases as a function of temperature.

7. The solid-state circuit of claim 1, wherein the control circuit is characterized by a minimum bias current, and wherein the solid-state circuit is configured to provide only the leakage current to the control circuit when the leakage current is greater than the minimum bias current.

8. The solid-state circuit of claim 7, wherein the solid-state circuit is configured to provide the minimum leakage current to the control circuit when the leakage current is smaller than the minimum bias current.

9. A method for operating a solid-state circuit, wherein the solid-state circuit comprises a pass device having a first terminal, a second terminal and a drive terminal, wherein the first terminal of the pass device is coupled with an input terminal of the solid-state circuit, and wherein the second terminal of the pass device is coupled with an output terminal of the solid-state circuit, wherein the solid-state circuit comprises a control circuit coupled with the drive terminal of the pass device, the method comprising driving, by the control circuit, the pass device with a driving voltage;

receiving, by a leakage current compensation circuit, a leakage current of the pass device; and forwarding, by the leakage current compensation circuit, said leakage current as a bias current to said control circuit.

10. The method of claim 9, wherein the leakage current compensation circuit is coupled to the second terminal of the pass device to receive the leakage current of the pass device.

11. The method of claim 9, wherein the control circuit comprises a differential amplifier stage for generating an intermediate signal based on a difference between a reference signal and a feedback signal indicative of an output voltage at the output terminal of the solid-state device, the method further comprising forwarding, by the leakage current compensation circuit, the leakage current to said differential amplifier stage.

12. The method of claim 11, wherein the control circuit comprises a further amplifier stage coupled between the differential amplifier stage and the pass device, and wherein the method further comprises forwarding, by the leakage current compensation circuit, the leakage current to said differential amplifier stage and said further amplifier stage.

13. The method of claim 9, wherein the leakage current increases as a function of temperature.

14. The method of claim 9, wherein the control circuit is characterized by a minimum bias current, and wherein the method further comprises providing only the leakage current to the control circuit when the leakage current is greater than the minimum bias current.

15. The method of claim 14, wherein the method further comprises providing the minimum leakage current to the control circuit when the leakage current is smaller than the minimum bias current.

* * * * *